US005083674A

United States Patent [19]

Clark

[11] Patent Number: 5,083,674

[45] Date of Patent: Jan. 28, 1992

[54] CONTAINER FOR EPOXY ADHESIVES AND THE LIKE

[75] Inventor: Bryan J. Clark, Waukesha, Wis.

[73] Assignee: Power Poxy, Inc., Brookfield, Wis.

[21] Appl. No.: 369,516

[22] Filed: Jun. 21, 1989

[51] Int. Cl.[5] ..... B65D 21/02

[52] U.S. Cl. ..... 220/4.27; 206/449; 206/508; 220/23.83; 156/69

[58] Field of Search ..... 206/503, 504, 508, 509, 206/568, 447; 220/23, 23.83, 23.86, 212, 23.4, 4 D, 4.27; 53/416, 449; 156/69

[56] References Cited

U.S. PATENT DOCUMENTS

| | | | |
|---|---|---|---|
| 819,336 | 5/1906 | Carnes | 220/4 D |
| 908,205 | 12/1908 | Clapp | 220/4 D |
| 941,303 | 11/1909 | Borden | 220/4 D |
| 1,542,115 | 6/1925 | Weis | 220/4 D |
| 1,984,570 | 12/1934 | Emmons | 220/4 D |
| 2,326,414 | 8/1943 | Thompson | 220/4 D |
| 2,629,508 | 2/1953 | Prager | 220/23 |
| 2,866,571 | 12/1958 | Henchert | 220/23.83 |
| 2,981,435 | 4/1961 | McCarthy | 206/568 |
| 3,079,037 | 2/1963 | Schechter | 220/212 |
| 3,954,178 | 5/1976 | Mason, Jr. | 206/508 |
| 4,690,271 | 9/1987 | Zak | 206/508 |
| 4,928,839 | 5/1990 | Kruelskie | 206/508 |

FOREIGN PATENT DOCUMENTS

| | | | |
|---|---|---|---|
| 0139188 | 5/1934 | Austria | 220/4 D |

*Primary Examiner*—Jimmy G. Foster

*Attorney, Agent, or Firm*—Michael D. Rechtin; Philip P. Mann

[57] ABSTRACT

A two compartment container for epoxy adhesives and the like includes a pair of upper and lower, pail-shaped containers, each including a removable cover. The lower end of the upper container is bonded to the cover of the lower container so that both containers form a unitary structure when the cover is in place on the lower container. Because the cover for the lower container is bonded to the upper container, the possibility of incorrectly replacing the covers on the upper and lower containers is minimized. A user graspable bail is attached to the upper container so that both containers can be easily carried as a unit when the covers are in place.

13 Claims, 1 Drawing Sheet

CONTAINER FOR EPOXY ADHESIVES AND THE LIKE

BACKGROUND OF THE INVENTION

This invention relates generally to containers and, more particularly, to containers for containing unmixed two-part compounds such as epoxy adhesives.

A variety of chemical compounds, such as epoxy adhesives, consist of two parts that must be stored separately and mixed together shortly before use. Typically, such compounds are sold to consumers in two separate containers that, except for their markings, are physically identical to each other. The use of two separate containers creates the possibility that one of the containers might become misplaced or otherwise "lost", and the use of physically similar containers increases the likelihood that the cap or top for one container might be inadvertently replaced on the other container, thereby contaminating either or both of the unused components.

To improve convenience, various dispenser devices, typically comprising twin chamber syringes and the like, have been developed for containing light bodied epoxy adhesives. Typically, the outlet nozzles of such devices are of dissimilar size or shape so that a complimentary plug can be inserted into the nozzles only if correctly oriented. This helps avoid incorrect insertion of the plug and helps avoid the possibility of contaminating the adhesive component parts. Although effective and convenient when used with light bodied epoxy adhesives that flow easily under pressure, such dispenser devices are impractical for use with heavy bodied epoxy adhesives and putties that resist such flow.

In view of the foregoing, it is a general object of the present invention to provide a new and improved container for storing two part chemical compounds such as epoxy adhesives and putties.

It is a further object of the present invention to minimize the possibility of misplacing or otherwise separating the containers for the unmixed component parts of a two-part compound such as an epoxy adhesive and the like.

It is a still further object of the present invention to provide a new and improved container for two-part compounds that avoids the possibility of contaminating the compound component parts through incorrect replacement of the container covers.

SUMMARY OF THE INVENTION

The invention provides a container for two-part chemical compounds and the like including a first receptacle having an open end, a first cover member removably mounted on the open end of the first receptacle in sealing engagement therewith, a second receptacle having a lower end affixed to the first cover member and having an open end opposite the lower end, and a second cover member removably mountable on the open end of the second receptacle in sealing engagement therewith.

In one embodiment, a carrying bail is affixed to the upper receptacle.

In one embodiment, each of the first and second receptacles is of substantially cylindrical form, and the receptacles are substantially coaxially aligned when the first cover member, and the second receptacle thereon mounted, are mounted on the open end of the first receptacle.

BRIEF DESCRIPTION OF THE DRAWINGS

The features of the present invention which are believe to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
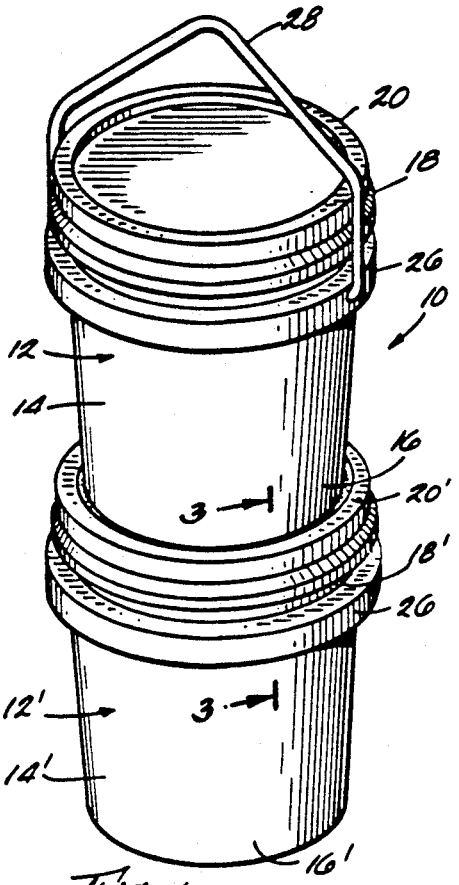
FIG. 1 is a perspective view of a container for epoxy adhesives and the like embodying various features of the invention.
Figure 2:
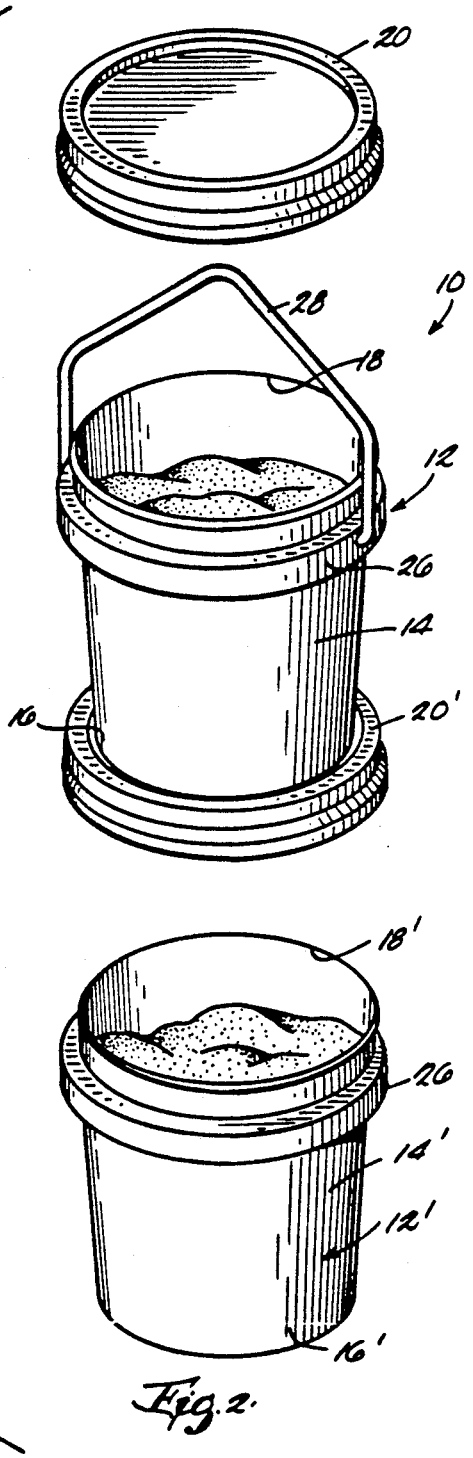
FIG. 2 is an exploded perspective view of the container shown in FIG. 1.

Referring to the drawings and, in particular, to FIGS. 1 and 2, a container 10 for two-part compounds and the like generally comprises a pair of upper and lower, substantially identical pail-shaped containers 12, 12', each of circular cross-section, stacked in coaxial alignment with each other. Each of the containers 12, 12' comprises a commercially available unit and includes a receptacle 14, 14' having a closed lower end 16, 16', an open upper end 18, 18' and a substantially disk-shaped cover member 20, 20' releaseably mountable on the upper end 18, 18' in sealing engagement therewith. The receptacle and cover member of each container is preferably formed of a molded plastic.

Figure 3:
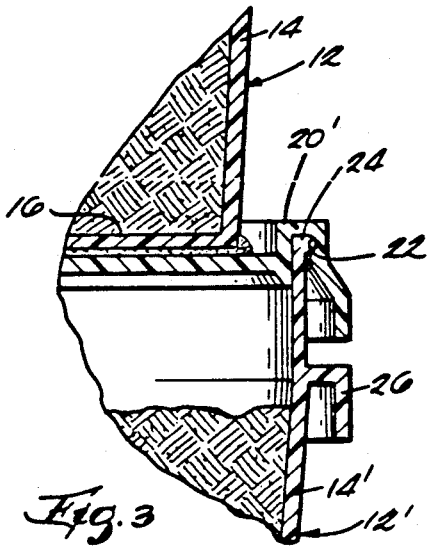
FIG. 3 is a fragmentary cross-sectional view of the container shown in FIG. 1 taken along line 3—3 thereof.

Each cover member 20, 20' includes an interior recess 22 (FIG. 3) adapted to engage a complimentary peripheral lip 24 formed around the open upper end of each receptacle 14, 14', and the cover members 20, 20' are resilently deformable so as to permit removable attachment over the open upper end of the receptacles 14, 14'. In use, each cover member 20, 20' can be pressed downwardly onto the open end of the appropriate receptacle 14, 14' to snap the peripheral lip 24 into the interior recess 22. To facilitate removal of the cover members 20, 20', a radially outwardly extending peripheral ledge 26, 26' is formed below the lip 24 of each receptacle 14, 14' to provide a fulcrum for prying the cover member off the receptacle.

In accordance with one aspect of the invention, the closed lower end 16 of the upper container receptacle 14 is firmly bonded to the cover member 20' of the lower container 12' so as to form a unitary structure. Accordingly, when the cover member 20' of the lower container 12' is in place on the receptacle 14', the upper and lower containers 12, 12' are detachably joined to each other. Preferably, the closed lower end 16 of the upper container 12 is of lesser diameter than the cover member 20' so that the closed lower end fits fully within the periphery of the cover member.

In accordance with another aspect of the invention, a user-graspable bail 28 is attached to the receptacle 14 of the upper container 12 so as to enable a user to carry the joined containers 12, 12' by means of the bail 28. Preferably, the bail 28 comprises a segment of rigid wire having opposed ends rotatably embedded in the peripheral ledge 26 of the upper container 12 at points spaced substantially diametrically opposite to each other across the open upper end 18 of the upper container receptacle 14.

In further accordance with the invention, the receptacle 14 of the upper of the upper container 12 is bonded to the cover member 20' of the lower container 12' by means of a hot melt adhesive such as, for example, 3764-AE Jet Melt adhesive manufactured by 3M. It has been discovered that by heating the hot melt adhesive substantially above its normal working temperature, the bond between the receptacle and cover member can be substantially improved. By way of example, when the Jet Melt hot melt adhesive is used, a superior bond is obtained if the adhesive is heated to between substantially 380° F. and 400° F. rather than its normal working temperature of between substantially 250° F. and 280° F.

The container 10 of the present invention provides an effective means for avoiding inadvertent separation and possible loss of the two components of a two-part chemical compound such as an epoxy adhesive. Furthermore, because the cover 20' of the lower container 12' is permanently affixed to the receptacle 14 of the upper container 12, the possibility of inadvertently switching covers, and thereby possibly contaminating the contents of the upper and lower containers, is substantially reduced.

While a particular embodiment of the invention has been shown and described, it will be obvious of those skilled in the art that changes and modifications may be made without departing from the invention in its broader aspects, and, therefore, the aim in the appended claims is to cover all such changes and modifications as fall within the true spirit and scope of the invention.

I claim:

1. A container for two-part compounds, comprising:

a first receptacle having an open end;

a carrying bail affixed to said first receptacle;

a first cover member removably mountable on said open end ;of said first receptacle in sealing engagement therewith and having an upper surface;

a second receptacle substantially identical to said first receptacle and having a lower end permanently affixed to said upper surface of said first cover member and further having an open end opposite said lower end; and a second cover member substantially identical to said first cover member removably mountable on said open end of said second receptacle in sealing engagement therewith.

2. A container as defined in claim 1 wherein said lower end of said second receptacle is affixed to said first cover member by means of a hot-melt adhesive, said hot-melt adhesive having been heated above its ordinary working temperature for bonding.

3. A container as defined in claim 1 wherein each of said first and second receptacles is substantially symmetrical around a central axis and wherein said first and second receptacles are substantially coaxially aligned when said first cover member and said second receptacle are mounted on said open end of said first receptacle.

4. A container as defined in claim 1 wherein each of said first and second receptacles is of substantial1y cylindrical form.

5. A container as defined in claim 4 wherein each of said first and second cover members is substantially disk-shaped and wherein said lower end of second receptacle is of smaller diameter than said first cover member 8 so that said lower end of said second receptacle fits fully within the periphery of said first cover member.

6. A container as defined in claim 5 wherein said first receptacle is substantially identical to said second receptacle and wherein said second cover member is substantially identical to said first cover member.

7. A two compartment container for two-part epoxy adhesives, comprising:

a first receptacle of substantially circular cross section having a closed lower end of a first diameter and an open upper end of a second diameter greater than said first diameter;

a first substantially disk-shaped cover member detachable mountable on said open upper end of said first receptacle in sealing engagement therewith;

a second receptacle substantially identical to said first receptacle and having a closed lower end of a first diameter and an open upper end of a second diameter greater than said first diameter, said closed end of said second receptacle being rigidly affixed to said first cover member so as to form unitary structure with said first cover member;

a second substantially disk-shaped cover member substantially identical to said first cover member detachably mountable on said open end of said second receptacle; and a user-graspable bail attached to said second receptacle and operable to allow a user to carry said container by means of said bail.

8. A container as defined in claim 7 wherein each of said first and second receptacles includes a radially outwardly extending peripheral ledge adjacent said open upper end for facilitating removal of said first or second cover members by means of prying.

9. A container as defined in claim 8 wherein said user graspable bail comprises a segment of rigid wire having opposed ends rotatably embedded in said ledge at points spaced substantially diametrically opposite each other across said open end of said second receptacle.

10. A container as defined in claim 7 wherein said lower end of said second receptacle is affixed to said first cover member by means of a hot-melt adhesive.

11. A method of forming a dual chamber container for two-part epoxy adhesives comprising the steps of:

providing first and second individual containers, each of said individual containers including a receptacle having a closed lower end, and open upper end and a cover member releasably mountable on said upper end; and bonding said lower end of said second container to the upper surface of said cover member of said first container so that said receptacle of said container and said cover member of said first container form a unitary structure and said bonding step comprising the step of heating a hot-melt adhesive above its normal working temperature and using said heated hot-melt adhesive to bond said receptacle of said second container to said upper surface of said cover member of said first container.

12. A method as defined in claim 11 wherein said hot-melt adhesive has a normal working temperature of between substantially 250° F. and 280° F. and is heated to between substantially 380° F. and 400° F. for bonding said receptacle of said second container to said upper surface of said cover member of said first container.

13. A container for two-part compounds, comprising:

a first receptacle having an open end;

a first cover member removably mountable on said open end of said first receptacle in sealing engagement therewith;

a second receptacle substantially identical to said first receptacle having a lower end affixed to said first cover member and having an open end opposite said lower end;

a second cover member substantially identical to said first cover member removably mountable on said open end of said second receptacle in sealing engagement therewith;

a carrying bail affixed to said first receptacle;

said lower end of said second receptacle being affixed to said first cover member by means of a hot-melt adhesive; and said hot-melt adhesive having been heated above its ordinary working temperature for bonding.

* * * * *